US006097407A

United States Patent [19]

Terasawa et al.

[11] Patent Number: 6,097,407

[45] **Date of Patent: *Aug. 1, 2000**

[54] PACKAGE FOR INK JET HEAD

[75] Inventors: Koji Terasawa, Mitaka; Takashi Nojima, Tokyo; Hideki Yamaguchi, Yokohama, all of Japan

[73] Assignee: Canon Kabushiki Kaisha, Tokyo, Japan

[ * ] Notice: This patent is subject to a terminal disclaimer.

[21] Appl. No.: 08/340,473

[22] Filed: Nov. 14, 1994

Related U.S. Application Data

[60] Continuation of application No. 08/008,606, Jan. 22, 1993, abandoned, which is a division of application No. 07/789,632, Nov. 12, 1991, Pat. No. 5,231,416, which is a continuation of application No. 07/433,848, Nov. 9, 1989, abandoned.

[30] Foreign Application Priority Data

| | | | |
|---|---|---|---|
| Nov. 9, 1988 | [JP] | Japan | 63-281430 |
| Oct. 6, 1989 | [JP] | Japan | 1-260186 |
| Oct. 26, 1989 | [JP] | Japan | 1-277059 |

[51] Int. Cl.[7] ..... B41J 2/165; B41J 29/13; B65D 81/26

[52] U.S. Cl. ..... 347/31; 347/108; 206/204; 206/723

[58] Field of Search ..... 346/146; 347/86, 347/87, 108, 29, 31; 206/204, 328, 576, 701, 723; 220/400, 470, 495.01

[56] References Cited

U.S. PATENT DOCUMENTS

| | | | |
|---|---|---|---|
| 4,276,554 | 6/1981 | Terasawa | 347/35 |
| 4,306,245 | 12/1981 | Kasugayawa et al. | 347/33 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,543,589 | 9/1985 | Terasawa | 347/31 |
| 4,558,333 | 12/1985 | Sugitani et al. | 347/65 |
| 4,599,625 | 7/1986 | Terasawa et al. | 347/87 |
| 4,600,927 | 7/1986 | Sugitani | 347/87 |
| 4,689,642 | 8/1987 | Sugitani | 347/87 |
| 4,695,851 | 9/1987 | Terasawa | 347/30 |
| 4,712,172 | 12/1987 | Kiyohara et al. | 346/1.1 |
| 4,723,129 | 2/1988 | Endo et al. | 347/56 |
| 4,728,970 | 3/1988 | Terasawa | 347/60 |
| 4,740,796 | 4/1988 | Endo et al. | 347/56 |
| 4,785,314 | 11/1988 | Terasawa et al. | 347/87 |
| 4,920,360 | 4/1990 | Terasawa et al. | 347/87 |
| 4,931,811 | 6/1990 | Cowger et al. | 347/87 |
| 5,231,416 | 7/1993 | Terasawa et al. | 347/23 |

FOREIGN PATENT DOCUMENTS

| | | | |
|---|---|---|---|
| 58-7362 | 1/1983 | Japan | 347/29 |
| 59-123670 | 7/1984 | Japan . | |
| 59-138461 | 8/1984 | Japan . | |
| 61-025844 | 2/1986 | Japan . | |
| 61-37436 | 2/1986 | Japan | 347/31 |
| 62-019460 | 1/1987 | Japan . | |

*Primary Examiner*—David F. Yockey
*Attorney, Agent, or Firm*—Fitzpatrick, Cella, Harper & Scinto

[57] ABSTRACT

A container including a lid contains an ink jet cartridge, with the lid permitting removal of the cartridge when opened. The cartridge has a head portion with a discharge opening therein. The container includes an ink absorbing member spaced apart from and facing the discharge opening.

2 Claims, 10 Drawing Sheets

PACKAGE FOR INK JET HEAD

This application is a continuation of application Ser. No. 08/008,606 filed Jan. 22, 1993, now abandoned, which in turn is a division of application Ser. No. 07/789,632 filed Nov. 12, 1991, now U.S. Pat. No. 5,231,416, which in turn is a continuation of application Ser. No. 07/433,848 filed Nov. 9, 1989, now abandoned.

BACKGROUND OF THE INVENTION

1. Field of the Invention

The present invention relates to a packing or wrapping member (referred as "container" hereinafter) for an ink jet recording head, and more particularly, relates to the packing member for an exchangeable ink jet recording head.

The present invention also relates to a container of an ink jet head with which an ink tank is made integral and attachable to or detachable from the ink jet recording apparatus, and relates to a recovering method printing quality of the ink jet head.

2. Related Background Art

In recent years, ink jet recording apparatuses have come into wide use as the output apparatuses of office computers, personal computers and word processors or the like.

An ink jet recording apparatus causes ink liquid in ink path of a recording head to discharge to thereby fly by the pressure generated by a piezo-electric element or the like to thereby effect recording on a recording medium, and has advantages such as low noise, low cost, capability of high-density recording and excellence in coping with colors.

Now, one type of ink jet recording apparatus is a the recording head interchange type recording apparatus. A predetermined usable time period exists in a recording head and therefore, a head which has reached this time period is exchanged for a new head to thereby ensure the reliability of the ink jet recording apparatus.

Among ink jet recording apparatuses, there is known one using an ink jet head (referred as "ink jet head cartridge") in which an ink tank containing therein ink which is a recording material and an ink jet head element (referred as "ink jet head unit" or "tank discharge portion") having the function of discharging the ink are made integral with each other. In such an ink jet head, there is adopted a method of exchanging the ink jet head itself together with the ink tank at a point in time at which the ink in the ink tank has been consumed by printing or when the discharge condition is aggravated for some reason or other and does not improve. Accordingly, discretely from a printer body, an integral ink tank type ink jet head removably mountable with respect to the printer is singly packaged for sale.

The transportation and preservation of such an integral ink tank type ink jet head have heretofore been accomplished with the integral ink tank type ink jet head 21 being contained in a housing 20 as shown in FIG. 1, and then a lid 22 being closed up tight by heat welding, or as shown in FIG. 2 with the ink jet head 21 being contained in the housing 20 with a tape 23 or the like attached to the discharge surface of the ink jet head 21 in which ink discharge openings 24 are disposed, and a lid being closed up tight by head welding. The increased viscosity of the ink caused by the evaporation of the ink solvent and the adherence of dust to the discharge opening portion are prevented by such a container.

Apart therefrom, in this recording head of the interchange type, during the first mounting of a head onto the recording apparatus or during the exchange of the head, a new head is mounted on the recording apparatus and a power source switch is closed to thereby effect the confirmation of printing and when discharge is unsatisfactory, a series of poor discharge recovery operations are effected. Also, when mounting a new head on the recording apparatus during the first mounting for the starting of the use of the recording apparatus or during the exchange of the head, it has often been the case that the new head requires the performing of the poor discharge recovering operation for the reason that new head has been in custody for long period of time.

Further, for the poor discharge recovering operation, a recovery mechanism has been discretely disposed in the recording apparatus or provided at the home position or the like of a carriage. FIG. 3 of the accompanying drawings shows an example of this, and the recovery mechanism 61 is provided at the home position of the carriage 62. When the carriage 61 comes to the home position, the cap 63 of the recovery mechanism 61 covers a discharge opening surface of recording head 64 mounted on the carriage and by operating a suction pump 65, ink liquid is sucked and discharged from the discharge opening of the recording head. Numeral 66 denotes a platen, 67 denotes a recording sheet, and 68 denotes a guide for the carriage 62. Thus, the ink jet head is provided with a mechanism for causing ink to flow out of the ink jet head by sucking the ink toward the printer body or pressurizing the ink when the ink jet head causes unsatisfactory printing, to thereby improve the printing condition, i.e., a so-called recovery mechanism.

However, in the above-described example of the prior art, when an attempt is made to take an ink jet head out of a new container and use it, the viscosity of ink in the discharge opening portion of the ink jet head may increase because of evaporation or the like of the ink solvent from the discharge openings of the ink jet head while the ink jet head is preserved in the container, or the stable discharge condition of the ink from the discharge openings may not be maintained, and there is no guarantee that the printing condition during the arrival of the printer is good. Also, as the time a printer is preserved increases, the frequency of the unsatisfactory printing upon the arrival of the printer becomes higher.

In other words, in the example of the prior art described above, once the lid of the package is peeled off, the air-tightness with respect to the external environment is lost. Even if the integral ink tank type recording head is again returned to and preserved in the package when the printer is not used for a long period of time, hermetic sealing cannot be secured. As a result the increased viscosity of the ink increases and dust adheres to the discharge openings because of evaporation of the ink solvent and unsatisfactory printing occurs when the recording head is then mounted on the printer. There is also the disadvantage that where the lid of the package is unsatisfactorily welded to the housing and there are holes or cracks in the lid and housing or where the recording head is left unused for a long period of time and preserved in the package, solidification of the ink in the discharge openings occurs. In order to solve these problems, printer bodies are provided with an ink recovery mechanism, but they have the disadvantage of a high cost.

Accordingly, even a new ink jet head sometimes requires the cumbersome operation of operating a recovery mechanism provided in the printer body when the printer arrives. Also, in this case, the recovery mechanism must be provided on the printer body side of the apparatus, and this has led to the increased cost and bulkiness of the printer body. Further, if the recovery mechanism is provided on the printer body side of the apparatus, the production of waste ink produced after the recovering operation requires a large waste ink reservoir (an ink absorber) on the supposition that a large amount of waste ink will be produced from the ink jet head used during the term during which the printer is guaranteed, and this has led to the problems of the contamination and increased cost of the printer body.

To summarize, the operation of effecting a poor discharge recovering operation on a new recording head by a recovery mechanism to thereby achieve stability of discharge is rather cumbersome, and to provide such a recovery mechanism in the recording apparatus, a space therefor must be provided in the recording apparatus.

SUMMARY OF THE INVENTION

In view of the above-noted problems, it is the object of the present invention to provide a wrapping member having a discharge stabilizing mechanism for a recording head which can achieve the stability of discharge of a new recording head without restoring to the complicated recovering operation by a recovery mechanism provided in a recording apparatus and accordingly does not always require the recovery mechanism to be provided in the recording apparatus.

Another object of the present invention is to provide a package for preserving an integral ink tank type recording head which has a good hermetic sealing property for the discharge openings of the integral ink tank type recording head and is reusable.

Still another object of the present invention is to provide a container of an ink jet head characterized by including a member for recovering the poor discharge from the discharge openings of the ink jet head in the container.

Still another object of the present invention is to provide a recovering method for an ink jet head, in which the ink jet head in use is re-mounted to the above container and in which, the recovery operation is carried out by using the container.

Still another object of the present invention is to provide a container for the ink jet head characterized by a closure member closing the discharge openings of the ink jet head in the container.

DETAILED DESCRIPTION OF THE PREFERRED EMBODIMENTS

A number of embodiments of the present invention will hereinafter be described in detail with reference to the drawings.

Figure 1:
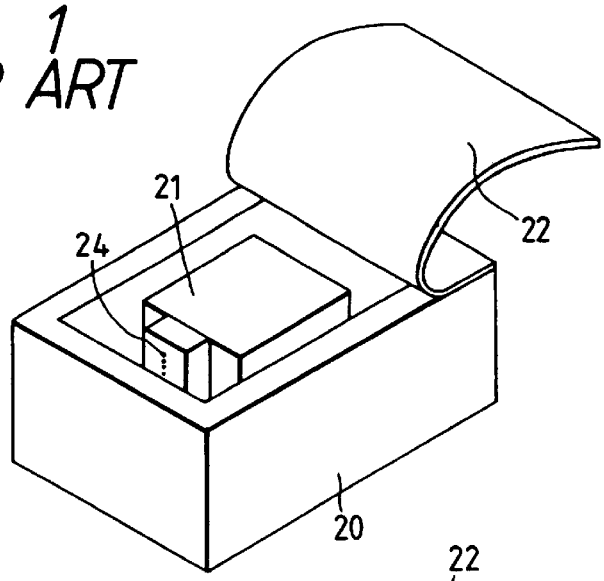
FIG. 1 PRIOR ART
FIGS. 1 and 2 are perspective views showing prior packing members.
Figure 2:
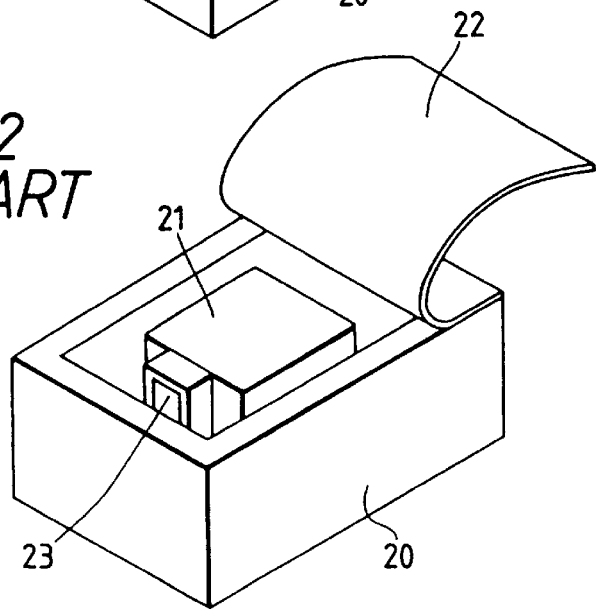
FIG. 2 PRIOR ART
Figure 3:
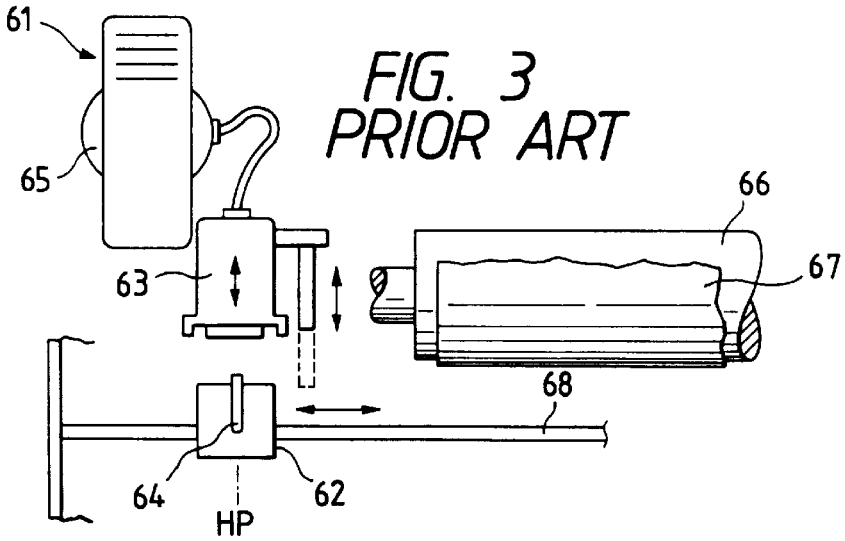
FIG. 3 PRIOR ART
FIG. 3 is a schematic upper view of an ink jet recording apparatus.
Figure 4:
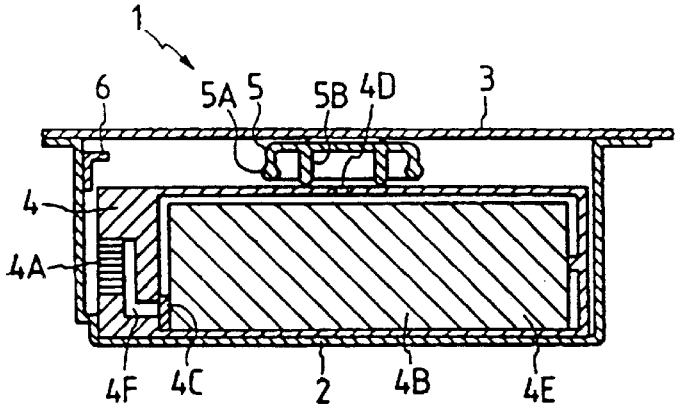
FIG. 4 is a cross-sectional view of a first embodiment of the packing member.
Figure 5:
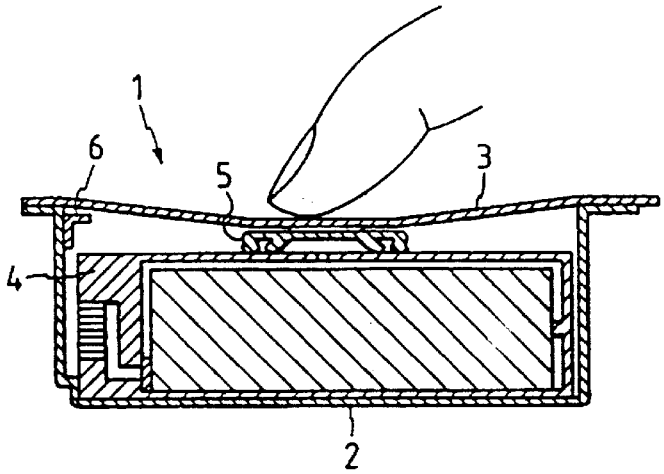
FIG. 5 is a cross-sectional view of the first embodiment of the packing member for explaining of the recovering operation in FIG. 4.
Figure 6:
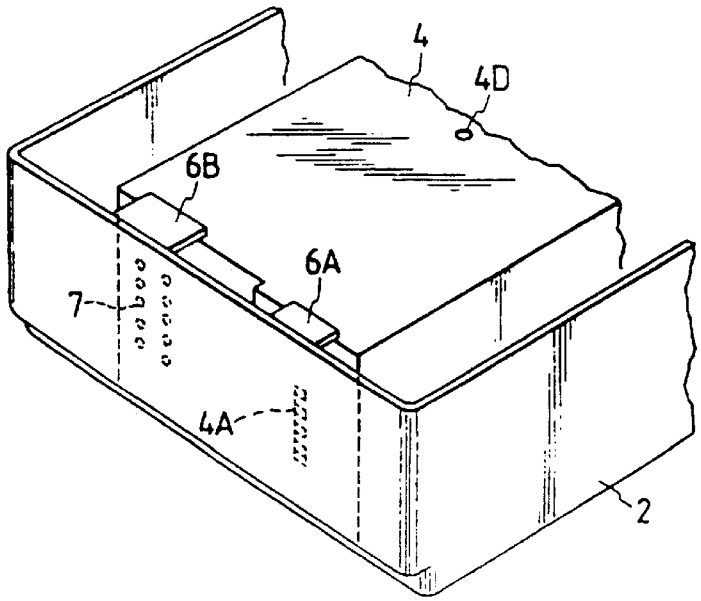
FIG. 6 is a perspective view of the packing member of FIG. 4 with the lid thereof removed.

A first embodiment of the present invention is shown in FIGS. 4 to 6, in which FIG. 4 is a cross-sectional view of the packing member of present embodiment, FIG. 5 illustrates the recovering operation, and FIG. 6 is a perspective view of a packing member with the lid thereof removed.

In FIG. 4, the reference numeral 1 designates the packing member containing a recording head 4 therein.

The recording head 4 is of a cartridge type in which a discharge portion and an ink tank are integral with each other. The ink tank 4B is filled with a porous material 4E impregnated with ink liquid, and communicates with discharge opening 4A through a filter 4C and a communication tube 4F. A vent hole 4D is provided in the upper portion of the ink tank 4B. An electrode portion 7 for connecting the recording head 4 to the flexible cable of the recording apparatus body is provided on the recording head 4 at the left of the discharge opening 4A, as shown in FIG. 6.

The packing member 1 is comprised of a case 2 and a lid 3 both formed of a material such as plastic or aluminum foil, and the two are brought into intimate contact by means such as a heat seal. At least the lid 3 can be curved by pressing. A resilient member 5 is secured to the underside of the lid 3 in opposed relationship with the position of the vent hole 4D by means such as a both-surface tape. The resilient member 5 is comprised of a counter-sunk seal portion 5A and two ribs 5B provided inside thereof at symmetrical positions; the lower ends of the ribs 5B protrude from the lower end of the seal portion 5A. A discharge opening blade 6A and an electrode blade 6B each having flexibility are provided inside the left side surface of the case 2 in opposed relationship with and above the discharge opening 4A and the electrode portion 7 (see FIG. 6).

The operation of the present embodiment will now be described.

When the user buys a new recording head 4, the recording head 4 is contained in the packing member 1 shown in FIG. 4. The user, as by reading an accompanying explanatory note, pushes the upper surface of the lid 3 near the central portion thereof with his finger or the like, as shown in FIG. 5.

Thereupon, the lid 3 becomes curved and the ribs 5B and seal portion 5A of the resilient member 5 come into contact with the upper surface of the recording head 4 and cause elastic deformation thereof. When the seal portion 5A causes elastic deformation while surrounding the vent hole 4D in a hermetically sealing state, the air in the seal portion 5A loses its way of escape and therefore, this air passes through the vent hole 4D into the ink tank 4B. Thereupon, the pressure in the ink tank 4B becomes higher and therefore, the ink liquid in the ink tank 4B passes through the filter 4C and communication port 4F into the discharge opening 4A, and the solidified ink or the like attached to the discharge opening 4A is discharged outwardly and the ink liquid as well as air presented in the ink path is discharged outwardly. In this manner discharge recovery is accomplished.

When the user then stops pushing the upper surface of the lid 3, the resilient member 5 is immediately separated from the upper surface of the recording head 4 by the resilient return force of the ribs 5B and therefore, the lower end surface of the seal portion 5A immediately comes off the upper surface of the recording head 4 and the reduced pressure state of the ink tank 4B is immediately eliminated, whereby the back flow of the ink liquid which has passed into the communication tube 4F and discharge opening 4A to the ink tank 4B is prevented.

If the above-described pushing and the stoppage of the pushing is effected several times, a more reliable recovering operation can be accomplished.

When the recovering operation is terminated, the lid 3 is peeled off as shown in FIG. 6. Then, the recording head 4 is taken out of the case 2. At that time, the discharge opening blade 6A and the electrode blade 6B rub the discharge opening 4A and the electrode portion 7, respectively, and therefore, any ink adhering to the surface of the discharge opening 4A and the electrode portion 7 is wiped off. As a result any abnormality of discharge by the ink adhering to the surface of the discharge opening 4A and the electrical conduction of the electrode portion 7 can be prevented.

After the recording head 4 has been taken out, the recording head 4 can be mounted on the recording apparatus and printing or image formation can be immediately effected.

In the present embodiment, the recovering operation is accomplished by pushing the lid 3 and therefore, the poor discharge recovery of the recording head can be accomplished very easily when the packing member is opened. Accordingly, where use is made of a recording head which is likely to cause unsatisfactory discharge during the recording operation or the like, it is not necessary that a recovery mechanism be discretely provided in the recording apparatus body. The resilient member 5 secured to the lid 3 may be preserved and in the event of unsatisfactory discharge in the course of recording, this resilient member may be used to effect discharge recovery.

Also, in the present embodiment, the blades 6A and 6B are provided on the case 2 and therefore, when the head 4 is taken out of the case 2, the ink discharged from the discharge opening 4A by the recovering operation is naturally wiped off and thus, the labor of wiping off such ink with discretely prepared cloth or the like can be omitted. Although in the present embodiment, the blades 6A and 6B are provided separately from each other, these may be made integral with each other.

Another embodiment of the present invention will now be described.

Figure 7:
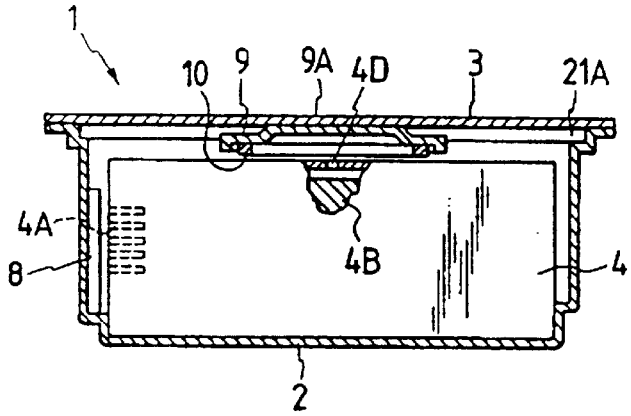
FIG. 7 is a cross-sectional view of another embodiment of the packing member.

A cross-sectional view of the present embodiment is shown in FIG. 7.

The present embodiment is such that a press portion 9A is provided in a protective member 9 fitted to a stepped portion 21A provided on the upper end of the case 2 (in the present embodiment, the protective member 9 is extended in a direction perpendicular to the plane of the drawing sheet in FIG. 7).

The protective member 9 is provided between the lid 3 and the recording head 4, and is designed so that when a shock force such as vibration fall occurs, the recording head 4 hits the protective member 9 and the protective member 9 performs the role as a shock absorber, whereby the force of the recording head 4 is prevented from being directly transmitted to the lid 3 made of a thin sheet such as aluminum foil.

Figure 8:
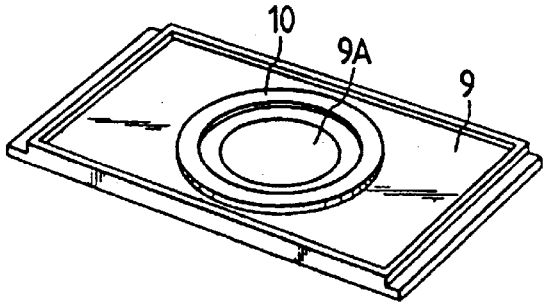
FIG. 8 is a perspective view of a protective member in FIG. 7 as it is seen from below.

The protective member 9 is made of a plastic sheet or the like, and has a concave press portion 9A formed in the central portion thereof. A packing member 10 having resiliency is adhesively or otherwise attached to and around the concave portion. A perspective view of the protective member 9 as it is seen from the packing member 10 side is shown in FIG. 8.

In using the recording head 4, the vicinity of the central portion of the lid 3 is pushed by a finger or the like as in the former embodiment. Thereupon, the lid 3 and the protective member become curved and the packing member 10 surrounds the vent hole 4D, and when the lid 3 is further pushed, the air in the concave portion is pressurized by the variation in the volume of the concave portion by the deformation of the packing member 10 and the elastic deformation of the press portion 9A and comes into the ink tank 4B through the vent hole 4D, whereby the ink liquid in the ink tank 4B is supplied to the discharge opening 4A. When the user stops pushing the lid 3, the protective member 9 is immediately restored to its original flat state by the resilient return force thereof, whereby the back flow of the ink liquid can be prevented as in the former embodiment. Resilient members similar to the ribs 5B in the first embodiment may be provided on the press portion 9A so that the packing member 10 may be pulled apart from the upper surface of the recording head 4 by the resilient return force of the ribs 5B.

The reference numeral 8 designates an ink liquid absorbing member made of a porous material or the like, and the ink liquid absorbing member 8 absorbs the ink liquid discharged from the discharge opening 4A. Accordingly, when the recording head 4 is taken out with the lid 3 peeled off, there is no ink liquid adhering to the surface of the discharge opening 4A and it is not necessary to wipe the surface of the discharge opening 4A by the use of cloth or the like.

Figure 9:
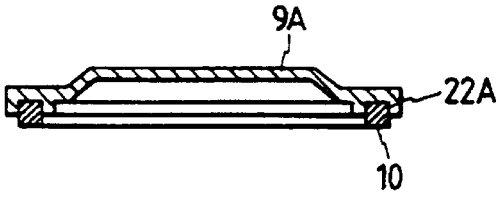
FIG. 9 is a cross-sectional view showing another example of the press portion of the protective member shown in FIG. 7.

FIG. 9 is a cross-sectional view of another form of the protective member 9. In this example, a groove 22A is formed around the press portion 9A and the packing member 10 is press-fitted in this groove 22A.

In the above-described two embodiments, the resilient member 5 or the press portion 9A is provided on the lid 3 side or the protective member 9 side, but alternatively, these may be secured to the upper surface of the recording head 4 and a vent hole may be formed in the upper surface of the resilient member 5 or the press portion 9A so that the resilient member 5 or the press portion 9A may be pressed with the vent hole closed by being pressed from the lid 3 side or the protective member 9 side and the pressurized air in the resilient member 5 or the press portion 9A may be supplied to the ink tank 4B through the vent hole 4D provided in the ink tank 4B.

Where the vent hole 4D is formed in the side surface or the like of the case 2, a resilient member 5 or the like may be provided on the side surface or the like of the case 2 so that by pressing the side surface or the like of the case 2, the pressurized air may be supplied to the ink tank 4B.

Still another embodiment of the present invention will now be described.

Figure 10:
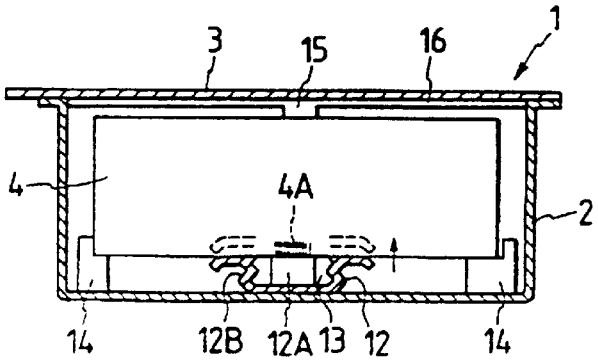
FIG. 10 is a cross-sectional view showing another embodiment of the packing member.

FIG. 10 is a cross-sectional view of a packing member containing a recording head therein.

In the present embodiment, a cradle 14 having a predetermined height is provided on the bottom surface of the case 2, and the recording head 4 is placed on the cradle 14, and a protective member 16 having a rib 15 provided on the underside of the lid 3 bears against the recording head from above, whereby the recording head is fixed within the packing member 1. Also, a counter-sunk resilient member 12 having a bellows portion 12B is attached to the bottom surface of the case 2 in opposed relationship with the discharge openings 4A. The resilient member 12 in its natural state extends up to the level indicated by dotted line in FIG. 10. An intimate contact member 12A for closing the discharge opening 4A is secured to the central portion of the resilient member 12. The intimate contact member 12A is designed such that in its natural state, it is slightly higher than the height of the cradle 14 (although not shown).

In the present embodiment, to contain the recording head 4 in the packing member 1, the bellows portion 12B of the resilient member 12 is first contracted to the height of the cradle 14 by predetermined means, and in this state, the recording head 4 is placed on the cradle 14, and the discharge openings 4A are closed by the initimate contact member 12A and a hermetically sealed clearance portion 13 is formed by the resilient member 12, and further the protective member 16 having the rib is brought into contact with the recording head 4 from above so that the recording head 4 may not move upward, and the lid 3 is placed on the protective member and is adhesively secured to the case 2. After the recording head 4 has been placed on the cradle 14, the force with which the resilient member 12 has so far been contracted by the predetermined means is eliminated so that the resilient return force of the resilient member 12 may act on the recording head 4.

The operation of the present embodiment will now be described.

When using the recording head 4, the lid 3 is peeled off from the case 2. Thereupon, the resilient member 12 is extended to the portion indicated by dotted line in FIG. 10 by the resilient return force of the resilient member 12 and at the same time, the recording head 4 is also raised. On the other hand, the intimate contact member 12A is provided with no bellows and the amount of extension thereof is slight and therefore, as soon as the bellows portion 12B is extended, the discharge openings 4A are uncovered and further, the volume of the clearance portion 13 increases, so that negative pressure is created in the clearance portion 13 and the liquid in the ink tank is discharged outwardly through the discharge openings 4A. By this means, the poor discharge recovery of the recording head 4 is accomplished.

The present embodiment, has the merit that if the packing member is opened, discharge recovery is automatically accomplished.

Figure 11:
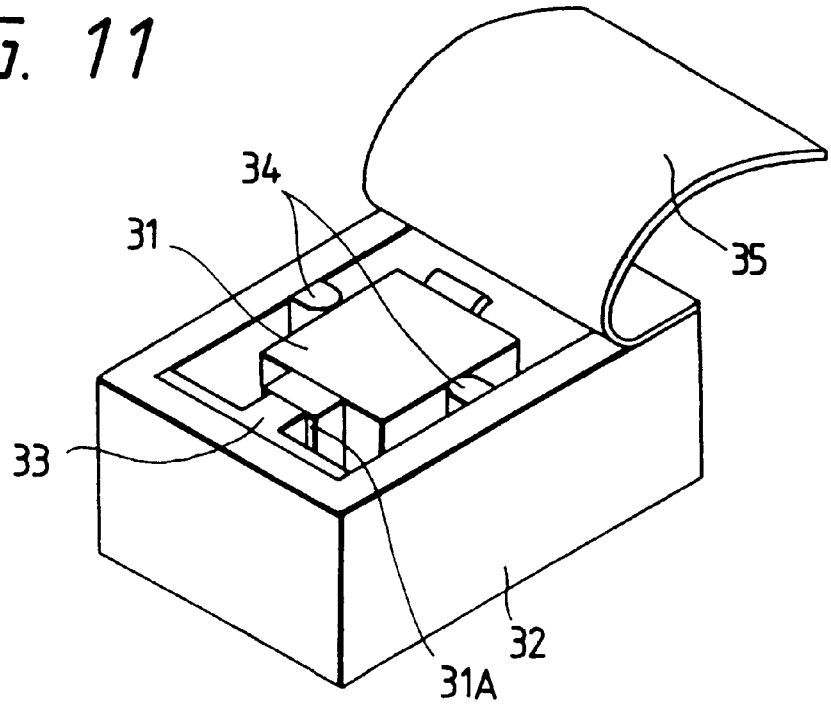
FIG. 11 is a perspective view showing still another embodiment of the package for preserving an integral ink tank type recording head according to the present invention.
Figure 12:
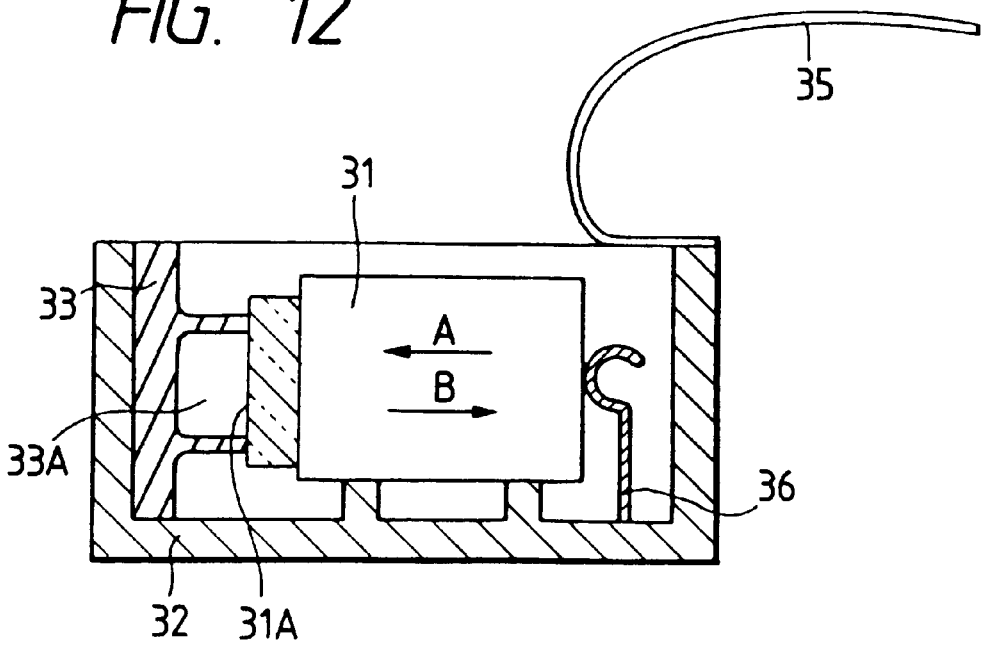
FIG. 12 is a cross-sectional view of the embodiment shown in FIG. 11.

FIG. 11 is a perspective view showing still another embodiment of the package for preserving an integral ink tank type recording head according to the present invention, and FIG. 12 is a cross-sectional view thereof.

In the present embodiment, an elastic cap 33 which is hermetically sealing means for hermetically sealing discharge openings provided in the front discharge surface 31A of the integral ink tank type recording head 31 is provided on one of the inner surfaces of a housing 32 which provides a package body, and further, a spring 36 which is a resilient member for biasing the integral ink tank type recording head 31 and pressing the front discharge surface 31A thereof against the elastic cap 33 is mounted near an inner surface opposed to the inner surface on which the elastic cap 33 is provided. Also, guides 34 for supporting the side surfaces of the integral ink tank type recording head 31 are provided on two surfaces corresponding to the side surfaces of the integral ink tank type recording head 31 in the inner surfaces of the housing 32.

This housing 32 is formed of an aluminum sheet or resin of low gas transmitting property, and is hermetically sealed by a lid 35 being welded to the upper surface thereof with the integral ink tank type recording head 31 contained therein. The lid 35 is formed of an aluminum sheet, or aluminum deposited by evaporation on a nylon or polyester film, and is welded to the housing 32 to thereby keep the air-tightness of the interior of the housing 32.

The aforementioned elastic cap 33 is formed of butyl rubber of low gas transmitting property, and is of such a cap-like shape having a concave portion in which the portion thereof corresponding to the front discharge surface 31A of the integral ink tank type recording head 31 can cover all the discharge openings provided in the front discharge surface 31A.

The integral ink tank type recording head 31 before being used is contained in the housing 32 as shown in FIG. 12, and is preserved in a hermetically sealed state with the lid 35 closed.

In this state, the integral ink tank type recording head 31 is biased in the direction of arrow A by the spring 36 and in the direction of arrow B by the elastic cap 33, and the front discharge surface 31A is pressed against the elastic cap 33. At this time, the concave portion of the elastic cap 33 cooperates with the front discharge surface 31A of the integral ink tank type recording head 31 to form a hermetically sealed space 33A, and the discharge openings provided in the front discharge surface 31A are shielded from the external environment and the desiccation of the discharge openings and the entry of foreign materials such as dust and the like are completely prevented. Also, when the integral ink tank type recording head 31 as it is thus contained in the package for preservation is to be transported, the opposite side surfaces of the integral ink tank type recording head 31 are supported by the two guides 34 and further, the head 31 is biased in its longitudinal direction by the elastic cap 33 and the spring 36 and the front discharge surface 31A is pressed by the elastic cap 33 and therefore, the air-tightness of the discharge openings is not spoiled even by vibration and inclination of the apparatus and further, it does not happen that the integral ink tank type recording head 31 is damaged.

When the integral ink tank type recording head 31 is to be taken out for use from the package for preservation, the lid 35 is first peeled off from the housing 32, and then the integral ink tank type recording head 31 is slid in a direction opposing the spring 36 (the direction of arrow B in FIG. 12) and the capping by the elastic cap 33 is released, whereby the head 31 is taken out. Then, the integral ink tank type recording head 31 is mounted on a recording apparatus body (not shown) for use.

Also, when the integral ink tank type recording head 31 once used is to be again preserved in the package for preservation, the integral ink tank type recording head 31 is pushed in the direction opposing the spring 36 as when the head 31 has been taken out, and the discharge openings of the integral ink tank type recording head 31 are capped by the elastic cap 33. By this capping, the air-tightness of the discharge openings is secured even in the state in which the lid 35 has been peeled off from the housing 32, and long-term preservation of the integral ink tank type recording head 31 becomes possible.

Still another embodiment of the present invention will now be described with reference to FIG. 13.

Figure 13:
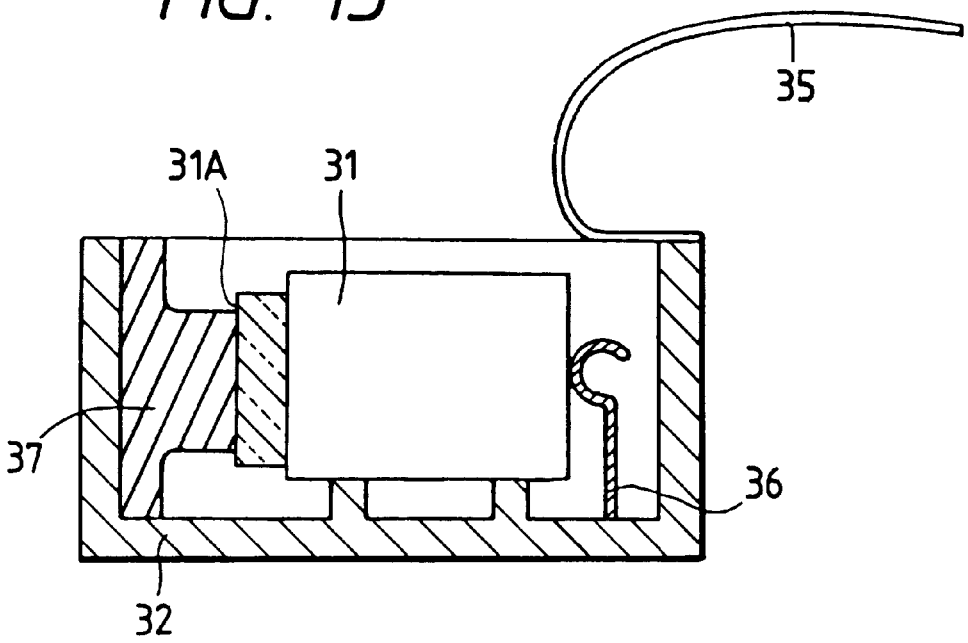
FIGS. 13 and 14 are cross-sectional views showing further embodiments.

FIG. 13 is a cross-sectional view showing the another embodiment, and in FIG. 13, portions identical to those in the previous embodiment are given identical reference numerals.

The difference of the present embodiment from the aforedescribed embodiment is that a resilient plate-like hermetically sealing member 37 is used instead of the cap-like elastic cap.

In this case, the hermetically sealing member 37 is in intimate contact with the front discharge surface 31A of the integral ink tank type recording head 31, whereby the discharge openings provided in the front discharge surface 31A are kept hermetically sealed. According to the present embodiment, the working of the hermetically sealing means becomes easy and this also leads to a reduced cost. Also, in the present embodiment, the hermetically sealing member 37 is in intimate contact with the front discharge surface 31A, but since this hermetically sealing member 37 is formed of an elastic material as previously described, it does not injure the front discharge surface 31A or the discharge openings.

Figure 14:
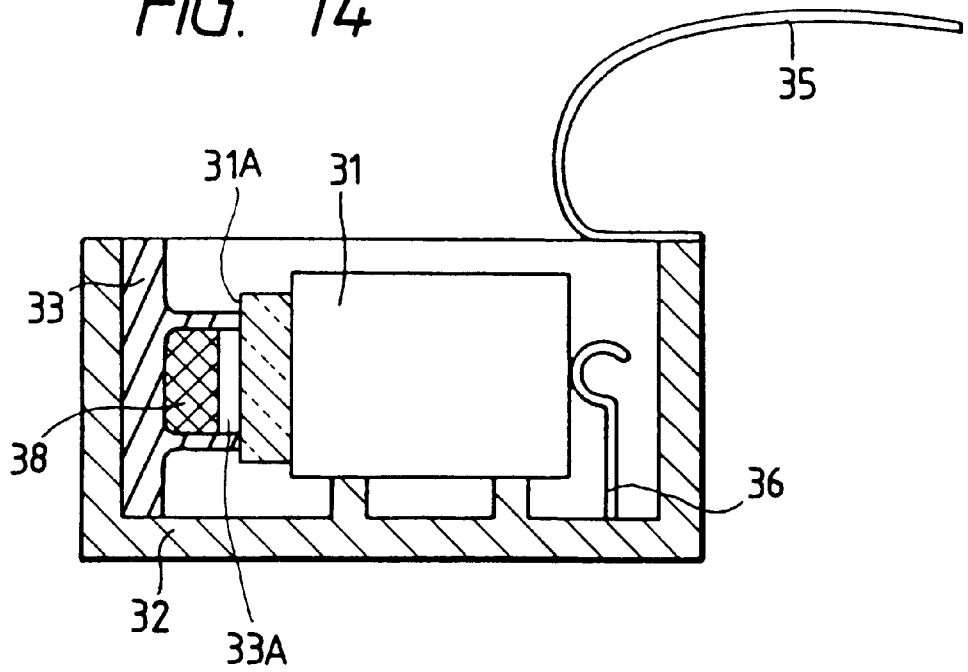

Still another embodiment of the present invention will now be described with reference to FIG. 14.

The present embodiment is such that a humidity retaining absorber 38 containing ink therein is housed in the concave portion of the elastic cap 33 in the aforedescribed embodiment shown in FIG. 12.

According to the present embodiment, the humidity retaining absorber 38 containing ink therein is present in the hermetically sealed space 33A formed by the elastic cap 33 and the front discharge surface 31A of the integral ink tank type recording head 31 and therefore, the interior of the hermetically sealed space 33A is kept at a moderate humidity, whereby the desiccation of the discharge opening portion can be prevented and the integral ink tank type recording head can be preserved for a long period of time with the discharge openings kept in a good condition.

In the present embodiment, the ink is retained by the humidity retaining absorber 38, whereas the use of the ink is not restrictive, but use may also be made of other solvent having a greater humidity retaining effect. Also, the humidity retaining absorber 38 may be connected to an ink chamber provided in the elastic cap 33 or elsewhere by the utilization of the capillary force of the humidity retaining absorber 38, whereby the amount of retained moisture may be further increased.

In each of the above-described embodiments, the means provided with a resilient member acts as means for pressing the front discharge surface of the integral ink tank type recording head against the hermetically sealing means, but alternatively, a filler having resiliency may be prepared discretely and this filler may be rammed into between the housing and the rear surface of the integral ink tank type recording head.

Figure 15A:
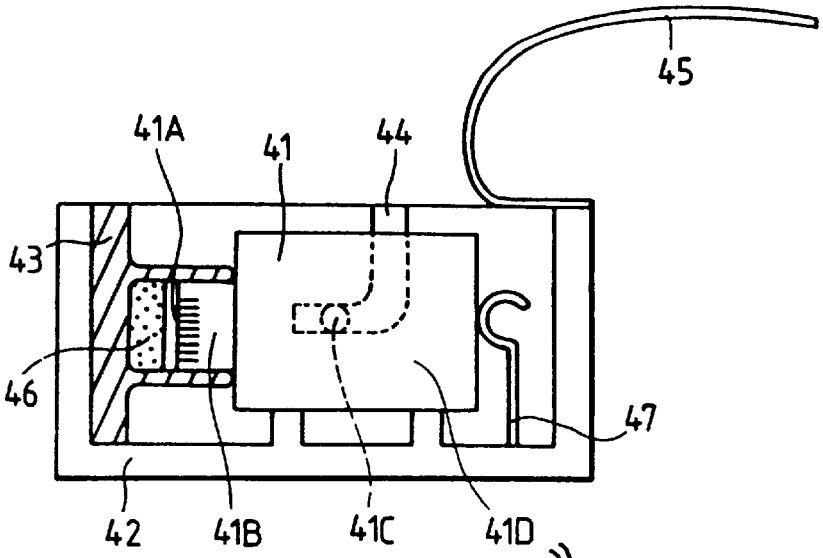
FIGS. 15A–15C, 16A, 16B, 17, 18A, 18B, 19A–19D, 20A and 20B are cross sectional views showing various embodiments of the container of the present invention.

FIG. 15A is a cross-sectional view of an embodiment of the container of the present invention. An ink jet head 41 to which an ink tank 41D is provided integrally is contained in a housing 42, and the front of the discharge opening portion of the ink jet head 41 is capped by an elastic cap 43, whereby the discharge opening portion is hermetically sealed. On the inner side surface of the housing 42, there is a guide 44 for guiding a projection 41C provided on a side of the ink jet head 41, and the ink jet head is moved along this guide 44, whereby the capping of the ink jet head 41 and the outflow of ink as well as the releasing of the capping can be accomplished reliably. A lid 45 is welded and closed up tight to the housing 42, and enhances the air-tightness with respect to the external environment and prevents an increased in viscosity of the ink and the entry of dust. In FIG. 15A, the weld is shown as being partly peeled off.

The material of the housing 42 is a sheet made of aluminum, or resin of low gas transmitting property. The elastic cap 43 can be formed of a material which does not affect the discharge opening portion 41B of the ink jet head when the cap is mounted or dismounted on or from the ink jet head 41 and which is of low gas transmitting property. A sponge-like ink absorber 46 is contained in the elastic cap 43. The size of the ink absorber is determined on the supposition that the ink jet head discharges a gross amount of waste ink. The reference numeral 47 designates a resiliently deformable spring member provided on a surface opposed to the elastic cap 43. The spring member 47 urges the ink jet head 41 toward the elastic cap 43 to thereby enhance the hermetic seal of the face at which the discharge opening 41A is formed of the ink jet head 41.

Figure 15B:
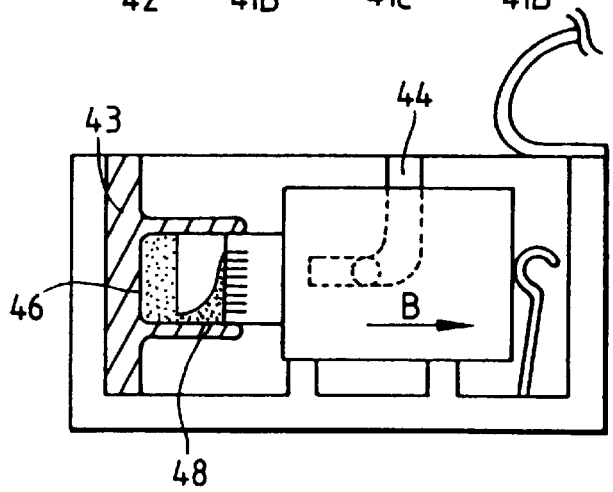

In FIG. 15A, ink outflow from the discharge opening 41A is accomplished by a sucking operation using capping. That is, suction is effected by the operation when the lid of the container supplied in its hermetically sealed state is peeled off and the ink jet head 41 is taken out, and negative pressure is created in the elastic cap 43 by the ink jet head being moved along the guide 44 and when this negative pressure exceeds the meniscus retaining force of the ink in the discharge openings, the ink is sucked from the discharge openings of the ink jet head and the increase in viscosity of the ink due to long-term preservation or the like and dust or the like adhering to the discharge openings can be sucked and eliminated with the ink (FIG. 15B).

Figure 15C:
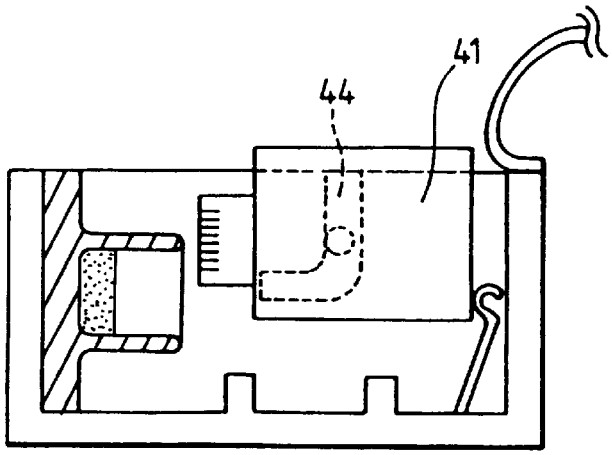

The ink which has flowed out is quickly absorbed by the ink absorber 46 so that the user's hand is not stained when the ink jet head is taken out (FIG. 15C).

The space between the surface at which the discharge openings is provided and the absorber 46 becomes pressurized when the discharge opening portion 41B is inserted into the cap 43, but since the cap is formed of an elastic material, the cap is deformed during its insertion and the shape thereof is restored after the insertion, whereby the degree of pressurization is small and the distance when the cap is pulled out next time becomes long and thus, a negative pressure is created. Also, the cap 43 is in intimate contact with the discharge opening portion 41B of the ink jet head 41, and some extension occurs to the elastic cap 43 when it is pulled out, and it seems that the negative pressure is created due to the increase in the distance.

Figure 16A:
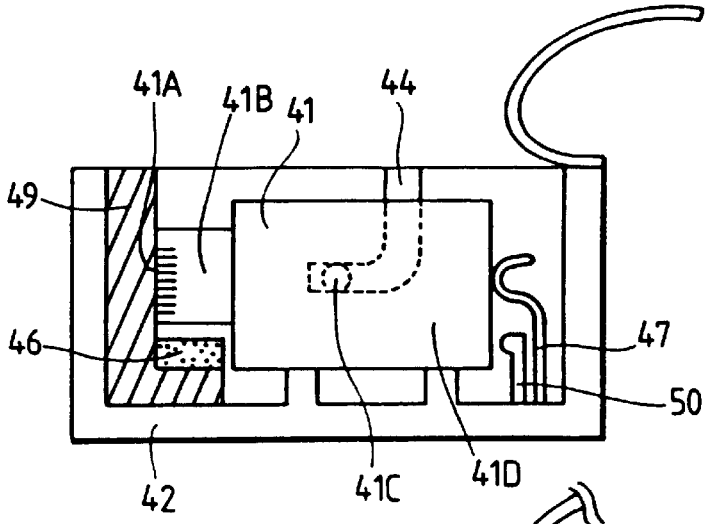
Figure 16B:
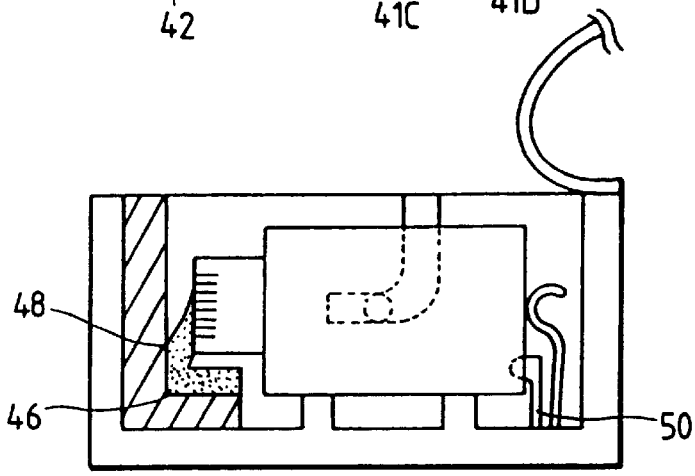
Figure 17:
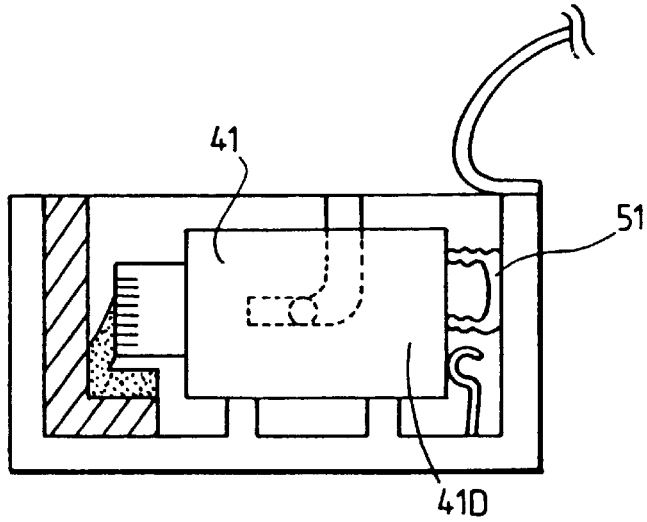

Also in the present invention, pressurizing means 41D for the ink tank can be used as the ink outflow means. In such case, as shown in FIG. 16A, the surface of the ink jet head where the discharge openings are provided is urged against an elastic member 49 as the cap by the resiliently deformable spring member 47 and the hermetically sealed property is secured by the elastic member 49 being compressed and caving in. Again in this container, as previously described, when the projected portion 41C of the ink jet head 41 is moved along the guide 44, the discharge opening portion 41B presses an ink bag (not shown) within the ink tank by a projection 50 provided rearwardly of the ink tank 41D at a position remote from the elastic member 49, and the ink is discharged from the discharge opening 41B. The discharged ink is absorbed by the absorber 46 provided in the lower portion of the container (FIG. 16B). Also, as the pressurizing means, a cap-like member 51 may be provided rearwardly of the ink tank 41D as shown in FIG. 17, and the ink jet head 41 may be moved so that the ink in the ink tank 41D may be pressurized by this member through a transmission hole (not shown) in the ink tank 41D.

By the operation described above, the recovering operation is effected as soon as the ink jet head is taken out of the container and therefore, without using a recovery mechanism heretofore provided in the printer apparatus body, a good printing condition is ensured in the ink jet head when it is taken out of the container.

It is also possible to restore a good printing condition by performing a series of operations of again inserting an ink jet head which has caused unsatisfactory discharge during printing into the container of the present invention and taking the ink jet head out of the container.

Further, heretofore, containers merely directed to the use for the transportation and preservation in the distribution process have been thrown out immediately after they have been opened, whereas the container of the present invention enables the ink jet head to be represerved therein, and where the printer is not used for a long period of time, the ink jet head may be returned into the container, whereby the ink discharge portion of the ink jet head may be hermetically sealed and thus, long-term preservation of the ink jet head becomes possible.

Embodiment a

A container was made into the construction as shown in FIG. 15A–15C. That is, as the housing 42, use was made of a molding formed of resin having a thickness of 2 mm (during the molding, the guide 44 and the spring member 47 were molded at a time), and the elastic cap 43 made of butyl rubber and having a thickness of 1 mm in the cap portion and having an ink absorber 46 of sponge embedded in the cap was fixed to the housing 42 by means of close fitting.

An ink jet head 41 was mounted in such a container and the lid 45 was secured to the container by heat welding.

The ink jet head 41 preserved in this container suffered from no increase in the ink even during long-term preservation, and ink outflow caused by the operation of taking the ink jet head out of the container, and the ink jet head 41 thus taken out was in a sufficiently usable condition when it was mounted on a printer.

Also, by performing the operation of inserting an ink jet head 41 which caused unsatisfactory printing into the housing, capping the ink jet head 41 and again taking out the ink jet head, the recovering operation of the ink jet head 41 was accomplished to thereby eliminate the unsatisfactory printing.

Embodiment b

A container of the construction shown in FIG. 16A and 16B was made. A molding formed of resin was used as the housing, and butyl rubber was used as the elastic member. In the present embodiment, the amount of ink discharged by the taking-out operation was about 0.1 ml, and the ink jet head 41 taken out was in a sufficiently usable condition when it was mounted on a printer.

Also, by performing the operation of inserting an ink jet head 41 which caused unsatisfactory printing into the housing 42, capping the ink jet head 41 and again taking out the ink jet head, the recovering operation of the ink jet head was accomplished to thereby eliminate unsatisfactory printing.

Embodiment c

Figure 18A:
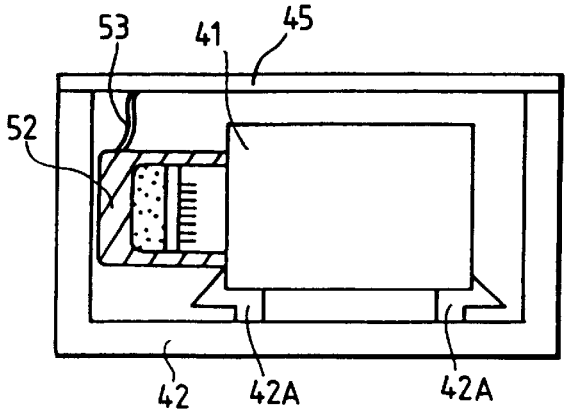
Figure 18B:
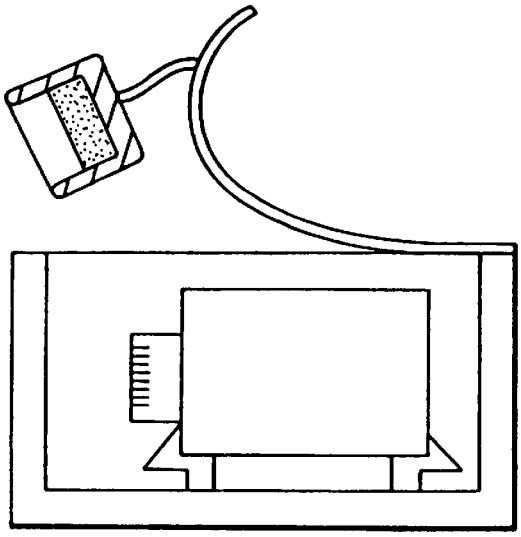

A container of the construction shown in FIG. 18A and 18B was made. The elastic cap 52 is connected to the lid 45 by a wire rod 53. The wire rod 53 was made of synthetic fiber.

By the operation of peeling off the lid 45, the cap 52 is pulled by the wire rod 53 connected to the lid and comes off from the ink jet head. At this time, negative pressure is created in the cap and ink outflow is achieved. The ink jet head is fixed to the housing via a fixing member 42A. The ink jet head thus taken out was in a sufficiently usable condition when it was mounted on a printer.

Also, by performing the operation of inserting an ink jet head 41 which caused unsatisfactory printing into the housing 42, capping the ink jet head and again taking out the ink jet head 41, the recovering operation of the ink jet head 41 was accomplished to thereby eliminate unsatisfactory printing.

Embodiment d

A container of the construction shown in FIG. 19A–19D was made.

Figure 19A:
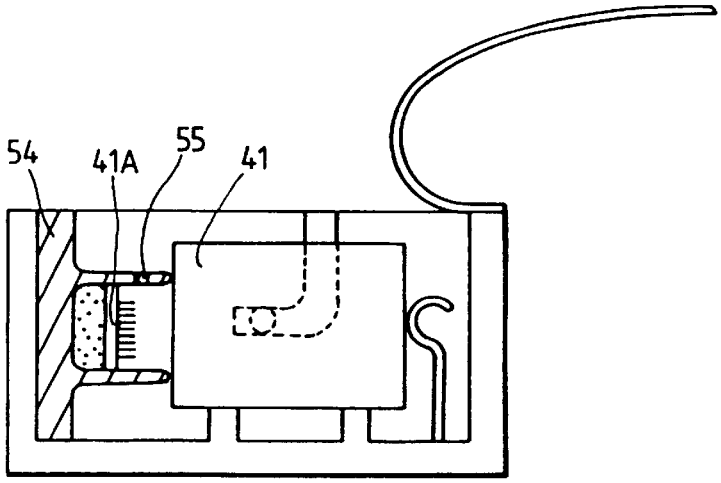
Figure 19B:
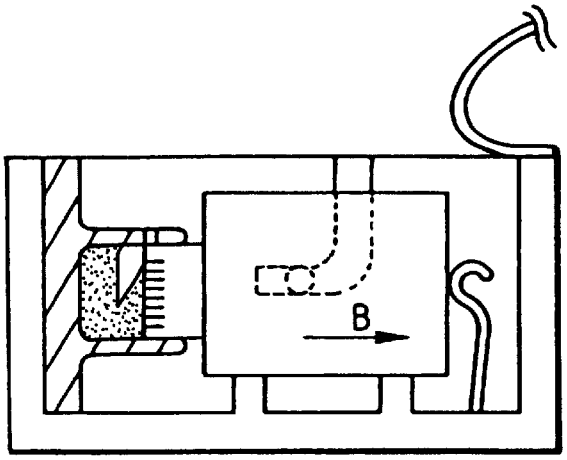
Figure 19C:
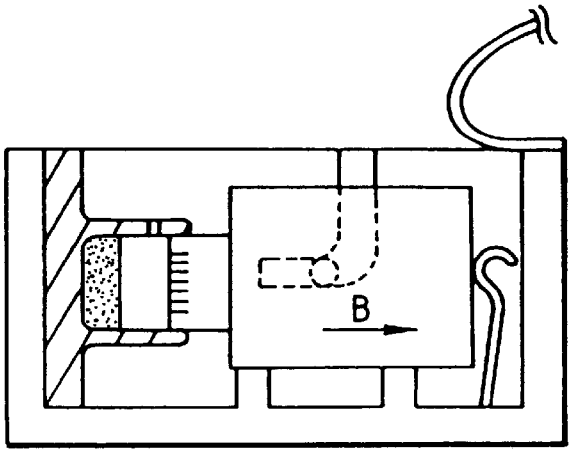
Figure 19D:
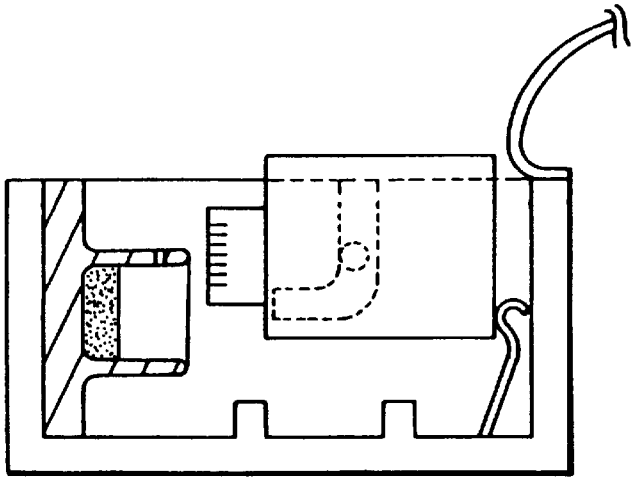

In FIG. 19A–19D, an aperture 55 is formed in the elastic cap 54 (FIG. 19A). Therefore, before the surface where the discharge openings are formed passes through the aperture 55, negative pressure is created and the discharge of the ink takes place (FIG. 19B), but when the surface arrives at the aperture portion 55, the inflow of air takes place from there and the negative pressure is eliminated and thus, ink outflow is terminated (FIG. 19C). As compared with the embodiment shown in FIG. 15A–15C, in this embodiment, the amount of ink outflow was small and the scattering of the ink when the ink jet head 41 came off from the cap 54 was less and almost null. The ink jet head 41 taken out was in a sufficiently usable condition when it was mounted on a printer.

Also, by performing the operation of inserting an ink jet head 41 which caused unsatisfactory printing into the housing 42, capping the ink jet head 41 and again taking out the ink jet head, the recovering operation of the ink jet head was accomplished to thereby eliminate the unsatisfactory printing.

Embodiment e

Figure 20A:
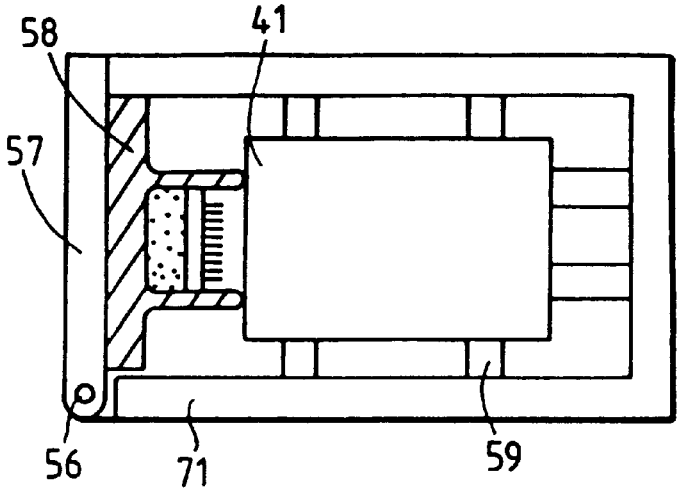
Figure 20B:
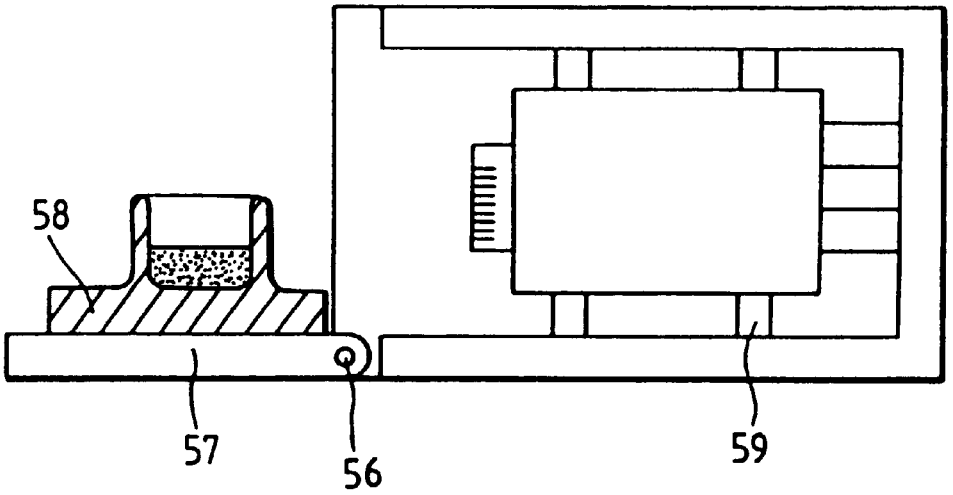

A container of the construction shown in FIGS. 20A and 20B was made.

A hinge portion 56 is was provided on the housing 71, and an elastic cap 58 is was fixed to a door 57 rotatable about the hinge portion 56, and pawls 59 for fixing the ink jet head 41 are provided in the housing 71. By the operation of inserting the ink jet head into the housing and closing the door 57, capping could be simply accomplished, and also when taking out the ink jet head 41, negative pressure is created in the cap 58 by the operation of opening the door and ink outflow took place, and the taking-out of the ink jet head can be accomplished easily.

Also, by performing the operation of inserting an ink jet head 41 which caused unsatisfactory printing into the housing 71, capping the ink jet head and again taking out the ink jet head 41, the recovering operation of the ink jet head was accomplished to thereby eliminate unsatisfactory printing.

The present invention brings an excellent effect particularly in an ink jet head of the bubble jet type among ink jet heads of the ink jet recording type.

As regards its typical construction and principle, it is preferable to use the basic principle disclosed, for example, in U.S. Pat. No. 4,723,129 or U.S. Pat. No. 4,740,796. This system is applicable to both of the so-called on-demand type and the continuous type, and in the case of the on-demand type, it is particularly effective because at least one driving signal corresponding to recording information and imparting a rapid temperature rise exceeding the nuclear boiling is applied to an electro-thermal converting member disposed correspondingly to a sheet or a liquid path in which liquid (ink) is retained, whereby heat energy is generated in the electro-thermal converting member and film-boiling is caused on the heat-acting surface of the ink jet head and as a result, a bubble in the liquid (ink) can be formed correspondingly in one to one correspondence to a driving signal. By the growth and contraction of this bubble, the liquid (ink) is discharged through discharge openings to form at least one droplet. If the driving signal is made into a pulse form, the growth and contraction of the bubble takes place appropriately on the spot and therefore, discharge of the liquid (ink) particularly excellent in responsiveness can be accomplished, and this is preferable. The driving signal in such pulse form may suitably be one as described in U.S. Pat. No. 4,463,359 or U.S. Pat. No. 4,345,262. If the conditions described in U.S. Pat. No. 4,313,124 which is an invention regarding the temperature rise rate of said heat-acting surface are adopted, more excellent recording can be accomplished.

As the construction of the ink jet head, besides a construction comprising a combination of discharge openings, a liquid path and an electro-thermal converting member (a straight liquid flow path or a right angle liquid flow path) as disclosed in each of the aforementioned patents, a construction using U.S. Pat. No. 4,558,333 or U.S. Pat. No. 4,459,600 which discloses a construction in which a heat-acting portion is disposed in a bent area is covered by the present invention. In audition, a construction based on Japanese Patent Laid-Open No. 59-123670 which discloses a construction in which a slit common to a plurality of electro-thermal converting members provides the discharge portion of the electro-thermal converting members and a construction based on Japanese Patent Laid-Open No. 59-138461 which discloses a construction in which an opening for absorbing the pressure wave of heat energy corresponds to the discharge portion are also effective in the present invention.

According to the present invention, the recovery mechanism of the recording head is provided in the packing member and therefore, in the work of unsealing the packing member, or removing operation of the packing member from the recording head, the poor discharge recovery of the recording head can be accomplished, and after the recording head is mounted on a recording apparatus, the recording operation can be immediately started. Accordingly, after the mounting of the recording head onto the recording apparatus, the cumbersome recovering operation by the recovery mechanism provided in the recording apparatus need not be passed through.

Further, where use is made of a recording head which is not likely to cause unsatisfactory discharge during the use, it is not necessary to provide a recovery mechanism discretely in the recording apparatus body.

Further, according to the present invention, ink outflow means is provided in the container, whereby the recovering operation is accomplished as soon as the ink jet head is taken out of the container by the operation of taking the ink jet head out of the container and therefore, without using a recovery mechanism heretofore provided in a printer apparatus body, a good printing condition is ensured when it is taken out of the container.

It is also possible to restore a good printing condition by performing a series of operations of again inserting an ink jet head which has caused unsatisfactory discharge during printing into the container of the present invention, and pulling out the ink jet head.

Further, heretofore, containers merely directed to the use for the transportation and preservation in the distribution process have been thrown out as soon as they have been opened, whereas the container of the present invention also enables an ink jet head to be represerved therein, and where the printer is not used for a long period of time, the ink jet head may be again returned into the container, whereby the ink discharge portion of the ink jet head may be hermetically sealed and thus, long-term preservation of the ink jet head becomes possible.

Further, according to the present invention following advantages or merits are achieved.

The entry of foreign materials such as dust and the like and the evaporation of the ink can be prevented by hermetically sealing the discharge openings disposed in the front discharge surface by the hermetically sealing means and therefore, the clogging of the discharge openings and the increased viscosity of the ink does not occur and for a long period of time, the integral ink tank type recording head can be preserved in a condition in which good discharge can be accomplished. Also, even after the lid is opened, the discharge openings can be kept hermetically sealed by the hermetically sealing means and the reuse of the recording head is possible, and thus economically advantageous.

The resilient member is provided to press the front discharge surface of the integral ink tank type recording head against the hermetically sealing means, whereby the hermetically sealed property of the discharge openings becomes higher.

Where the hermetically sealing means is of a cap-like shape and the humidity retaining member is housed in the concave portion thereof, when the discharge openings of the integral ink tank type recording head are hermetically sealed, the hermetically sealed portion is kept at moderate humidity, and this is effective for maintaining the viscosity of the ink.

Where the hermetically sealing means is formed of an elastic material, shocks such as vibration and inclination when the integral ink tank type recording head is transported while being contained in the package for preservation can be absorbed, and the damage of the integral ink tank type recording head is prevented and also the hermetically sealed property of the discharge openings is secured.

What is claimed is:

1. A product comprising:

an ink jet cartridge having an ink jet head portion for discharging ink and an ink tank portion for storing the ink and for supplying the ink to the ink jet head portion, the ink jet head portion having an ink discharge opening;

a container body, separate from the ink jet cartridge and containing the ink jet cartridge, said container body having an opening;

a lid member, attached to said container body at a periphery of the opening of said container body and detachable therefrom, for enclosing said ink jet cartridge in said container body; and an ink absorbing member, disposed in said container body spaced apart from and facing the ink discharge opening, for absorbing the ink that may flow from the ink jet head portion while the ink jet cartridge is enclosed in said container body.

2. A product according to claim 1, wherein the ink jet head portion discharges the ink from the ink discharge opening.

* * * * *

UNITED STATES PATENT AND TRADEMARK OFFICE

CERTIFICATE OF CORRECTION

PATENT NO. : 6,097,407
DATED : August 1, 2000
INVENTOR(S) : Terasawa et al.

It is certified that error appears in the above-identified patent and that said Letters Patent is hereby corrected as shown below:

Column 1,
Line 14, "(referred" should read -- (referred to --; and
Line 32, "the" should be deleted.

Column 2,
Line 10, "new" should read -- the new --, and "in custody" should read -- packaged --; and
Line 49, "increased" should be deleted.

Column 3,
Line 20, "restoring" should read -- resorting --; and
Line 54, "of" should be deleted.

Column 4,
Line 9, "cross sectional" should read -- cross-sectional --.

Column 9,
Line 3, "another" should read -- other --.

Column 10,
Line 5, "increased" should read -- increase --; and
Line 40, "is" should read -- are --.

Column 11,
Lines 28, 50 and 64, "FIG." should read -- FIGs. --.

Column 12,
Lines 17, 19 and 27, "FIG." should read -- FIGs. --;
Lines 42 and 43, "was" should be deleted; and
Line 47, "could" should read -- can --.

UNITED STATES PATENT AND TRADEMARK OFFICE

CERTIFICATE OF CORRECTION

PATENT NO. : 6,097,407
DATED : August 1, 2000
INVENTOR(S) : Terasawa et al.

It is certified that error appears in the above-identified patent and that said Letters Patent is hereby corrected as shown below:

Column 13,
Line 30, "audition," should read -- addition, --.

Signed and Sealed this

Fifteenth Day of January, 2002

*Attest:*

*Attesting Officer*

JAMES E. ROGAN
*Director of the United States Patent and Trademark Office*